US011666815B2

(12) United States Patent
Zwingenberger et al.

(10) Patent No.: US 11,666,815 B2
(45) Date of Patent: Jun. 6, 2023

(54) CLIMBING ELEMENT AND CLIMBING SYSTEM

(71) Applicant: Blocz GmbH, Chemnitz (DE)

(72) Inventors: Andre Zwingenberger, Chemnitz (DE); Sebastian Flemmig, Chemnitz (DE)

(73) Assignee: Blocz GMBH, Chemnitz (DE)

( * ) Notice: Subject to any disclaimer, the term of this patent is extended or adjusted under 35 U.S.C. 154(b) by 0 days.

(21) Appl. No.: 17/677,047

(22) Filed: Feb. 22, 2022

(65) Prior Publication Data

US 2022/0266113 A1 Aug. 25, 2022

(30) Foreign Application Priority Data

Feb. 19, 2021 (DE) ..... 10 2021 103 950.9

(51) Int. Cl.
*A63B 69/00* (2006.01)

(52) U.S. Cl.
CPC ..... *A63B 69/0048* (2013.01); *A63B 2209/00* (2013.01)

(58) Field of Classification Search
CPC ..... A63B 69/0048
See application file for complete search history.

(56) References Cited

U.S. PATENT DOCUMENTS

| | | | | | |
|---|---|---|---|---|---|
| 6,074,327 | A * | 6/2000 | Franklin | ..... | A63B 69/0048 249/55 |
| 2005/0109559 | A1 | 5/2005 | Eike | | |
| 2005/0245355 | A1 * | 11/2005 | Brewer | ..... | A63B 69/0048 482/37 |

FOREIGN PATENT DOCUMENTS

| | | | | | |
|---|---|---|---|---|---|
| DE | 2433084 | B2 | 12/1976 | | |
| DE | 4423162 | A1 | 1/1996 | | |
| DE | 102011008098 | A1 | 7/2012 | | |
| DE | 102017112555 | A1 | 12/2018 | | |
| FR | 3004358 | A1 * | 10/2014 | ..... | A63B 69/0048 |
| KR | 100698412 | B1 | 3/2007 | | |
| KR | 10-1839114 | * | 3/2018 | ..... | A63B 69/0048 |
| WO | WO-2017009593 | A1 * | 1/2017 | ..... | A63B 69/0048 |

* cited by examiner

*Primary Examiner* — Jennifer Robertson
(74) *Attorney, Agent, or Firm* — Laurence A. Greenberg; Werner H. Stemer; Ralph E. Locher

(57) ABSTRACT

A climbing element has a through-opening running from a visible side to a rear side. A reinforcing element is arranged on or in the through-opening and has a passage opening arranged concentrically with the through-opening, wherein one end of the reinforcing element forms a screw head counterhold. Either the reinforcing element is composed of a counter-holding element having the screw head counterhold and a tubular rivet protruding from the rear side into the through-opening, or the reinforcing element is a single element, the underside of which is pressed into the plastic of the climbing element on the visible side of the climbing element, with an upper side of the reinforcing element being at least partially covered by the plastic.

9 Claims, 1 Drawing Sheet

CLIMBING ELEMENT AND CLIMBING SYSTEM

CROSS-REFERENCE TO RELATED APPLICATION

This application claims the priority, under 35 U.S.C. § 119, of German Patent Application DE 10 2021 103 950.9, filed Feb. 19, 2021; the prior application is herewith incorporated by reference in its entirety.

FIELD AND BACKGROUND OF THE INVENTION

The present invention relates to a climbing element with at least one through-opening running from a visible side to a rear side of the climbing element, wherein a reinforcing element is arranged on or in the through-opening, which has a passage opening arranged concentrically with the through-opening and wherein one end of the reinforcing element forms a screw head counterhold.

The invention also relates to a climbing system with at least one climbing element mounted on a climbing wall.

Artificial climbing structures for climbing and bouldering have climbing walls to which different climbing elements, such as holds and volumes, are attached. The respective climbing wall usually consists of individual multiplex panels that are mounted on a stable framework.

The climbing elements are usually attached to the climbing wall by means of a detachable screw connection. As a result, the climbing elements can be easily interchanged and/or rearranged on the climbing wall at any time. In this way, different climbing routes can be displayed on an unchanged climbing wall.

There are essentially two mounting methods for the detachable screw connection. The climbing element is either screwed into a nut incorporated into the multiplex panel of the climbing wall with a machine screw or fastened with a wood screw, which is screwed directly into the wood of the multiplex panel.

In order to offer the climbers variety, the operator of a climbing wall typically changes the climbing routes every two to four weeks. With a climbing wall having a regular service life of 10 years, a single climbing element can be screwed into and removed from the climbing wall hundreds of times.

Frequent attaching and detaching places high mechanical stress on the climbing elements, which in turn are subject to high safety requirements in accordance with DIN EN 12572.

The high safety requirements for the climbing elements in conjunction with the frequent stresses when attaching and detaching the climbing elements on a climbing wall make the production of large climbing elements, so-called "volumes" or "macros," expensive and complex.

Smaller climbing elements are mainly manufactured by casting using thermosetting plastics such as polyurethane or synthetic resin. The manufacture of smaller climbing elements by casting can thus still be managed with a reasonable amount of effort, even in large quantities. The climbing elements, which are cast with thermosetting plastics, have through-openings through which a wood or machine screw can be inserted in order to screw the climbing element into a climbing wall. In order to prevent the climbing element from tearing or splitting in the region of the through-openings when it is frequently attached to or detached from a climbing wall, it is known to reinforce this particularly stressed region with a reinforcing element which is arranged in or on the through-opening.

Reinforcing elements used for this purpose have a passage opening which is arranged concentrically with the through-opening running from the visible side to the rear side of the climbing element. A screw for attaching the climbing element to a climbing wall can be passed through this passage opening. One end of the reinforcing element forms a screw head counterhold, which is pressed by the screw head of the fastening screw when the climbing element is attached to a climbing wall.

A climbing hold is known from published, non-prosecuted German patent application DE 10 2017 112 555 A1, which climbing hold has a hold body with an opening into which a clamping body is introduced. When this climbing hold is attached to a climbing wall, the force exerted by a fastening means acts on the clamping body, as a result of which the hold body can be fitted without stress.

A break-resistant climbing hold based on elastomers is known from published, non-prosecuted German patent application DE 10 2011 008 098 A1.

Published, non-prosecuted German patent application DE 44 23 162 A1 describes a holding element consisting of a plastics/quartz mixture.

In a climbing hold known from Republic of Korea patent KR 10 0 698 412 B1, a large number of wires are embedded in the material of the hold body. The wires serve to reinforce the climbing hold and prevent parts of the climbing hold from falling down in the event of a break.

A luminescent climbing hold that glows in the dark is described in U.S. patent publication No. 2005/0109559 A1.

Metal inserts are often used to reinforce fastening openings in fiber composites. German patent DE 24 33 084 B2 discloses a metallic insert with a cylindrical shank and a circular disk attached thereto. This insert is glued into the opening to be reinforced, with the circular disc being flush with the surface of the component.

U.S. Pat. No. 6,074,327 describes a climbing hold in which a reinforcing sleeve is passed through the through-opening. Such a reinforcing sleeve can easily be integrated into the through-opening of a climbing hold during the manufacture of a climbing hold by casting.

For the manufacture of larger climbing elements, so-called "volumes" or "macros," the casting process described above is no longer an option, since this would lead to too much material being used in manufacture and the resulting weight of the climbing elements being too high. The manufacture of large climbing elements, in particular of "volumes" or "macros," is therefore still laboriously done by hand.

Manual production is an extremely monotonous and usually poorly paid job, in which the worker is also exposed to a high concentration of solvents. In addition, the individual quality of products manufactured in this way is subject to large fluctuations. In addition to wood, macros are mainly made of fiber(glass) reinforced plastic laminate. Manually producing a single macro, layer by layer, can take several hours. Suitable reinforcing elements are laminated in during the manufacturing process to reinforce the through-openings. However, the laminated reinforcing elements can burst out of the brittle plastic laminate if the fastening screws are tightened and loosened suddenly with a cordless screwdriver. The fulfillment of the safety requirements by the relevant climbing element is then no longer guaranteed, as a result of which it must be withdrawn from circulation.

The disposal of damaged or discarded macros made of fiberglass reinforced plastic laminate represents a high and outmoded burden on the environment, since it is hazardous waste that cannot currently be recycled, but can only be used thermally.

SUMMARY OF THE INVENTION

It is therefore the object of the present invention to provide a climbing element that is more environmentally friendly, safer and at the same time more economical to manufacture.

This object is achieved by a climbing element with at least one through-opening running from a visible side to a rear side of the climbing element, on or in which a reinforcing element is arranged, which has a passage opening arranged concentrically with the through-opening, one end of the reinforcing element forming a screw head counterhold. The climbing element being predominantly made of thermoplastic material. Either the reinforcing element is composed of a counter-holding element having the screw head counterhold and a tubular rivet protruding from the rear side into the through-opening, wherein a collar of the tubular rivet lies on the rear side of the climbing element and a free end region of the tubular rivet opposite the collar of the tubular rivet is passed through the counter-holding element and flanged, or the reinforcing element is a single element, the underside of which is pressed into the plastic of the climbing element, with an upper side of the reinforcing element being at least partially covered by the plastic.

Since the climbing element according to the invention is predominantly made of thermoplastic material, it can be produced inexpensively by injection molding or deep-drawing. The manufacture of large climbing elements, such as macros, benefits in particular from this, as this replaces tedious manual production.

The present invention also provides a particularly safe and durable climbing element, since the through-opening running from the visible side to the rear side of the climbing element is reliably provided with the reinforcing element, so that the climbing element permanently withstands the recurring, heavy stresses of detaching from and attaching to a climbing wall.

According to the invention, the reinforcing element is either composed of a counter-holding element having a screw head counterhold and a tubular rivet, or it consists of a single element which is pressed into the thermoplastic material. In both cases, the reinforcing element can be easily and yet reliably integrated into the climbing element.

In the first case, a free end of the tubular rivet is passed from the rear side through the through-opening of the climbing element and through the counter-holding element forming the screw head counterhold and flanged on the visible side of the climbing element, whereby the counter-holding element is fixed to the through-opening of the climbing element. The collar of the tubular rivet lying opposite the free end of the tubular rivet lies flat on the rear side of the climbing element, so that the reinforcing element is fixed on both sides at the ends of the through-opening.

The through-openings in the climbing element can either be drilled into the climbing element after it has been shaped by injection molding or deep-drawing, or they can be produced in the shaping process itself. For example, the through-openings can be left out during injection molding.

Washers, rosettes, spring washers or nuts are particularly suitable as counter-holding elements. However, numerous other objects that have a passage opening and a screw head counterhold are also options. In addition to flat objects that lie on the through-opening, hollow-cylindrical objects such as insertion sleeves that are inserted into the through-opening from the visible side and have a collar that lies flat on the visible side of the climbing element and represents a suitable screw head counterhold are also suitable.

The screw head counterhold offers a bearing surface for a screw head of a screw with which the climbing element is attached to a climbing wall. If the screw is tightened when attaching the climbing element to a climbing wall, the underside of the screw head presses against the screw head counterhold of the counter-holding element. There is therefore no direct stress on the through-opening of the climbing element from the screw head.

The passage opening of the counter-holding element is arranged concentrically with the through-opening of the climbing element. The diameter of the passage opening preferably corresponds to the diameter of the through-opening of the climbing element minus the wall thickness of the tubular rivet used for attachment.

In the case of the climbing element according to the invention, a fastening of the reinforcing element is also provided in which no tubular rivet is used. In this case, the reinforcing element consists of only one element, namely the counter-holding element itself.

According to the invention, the underside of the reinforcing element, which consists of only a single element, is pressed on the visible side of the climbing element into the still deformable thermoplastic material until the thermoplastic material overflows onto the upper side of the reinforcing element as a result of displacement from the edge of the reinforcing element. After cooling down, the partially sunk reinforcing element sits firmly in the plastic and is thus reliably secured against falling off or slipping.

Both variants of attachment guarantee a durable arrangement of the reinforcing element on the through-opening of the climbing element, which also permanently withstands frequent, jerky shearing when attaching and detaching the climbing element to/from a climbing wall with a cordless screwdriver.

Merely fixing the reinforcing element to or in the through-opening of the climbing element with adhesive alone is not sufficient to achieve a comparably reliable attachment of the reinforcing element.

The climbing element according to the invention is also significantly more environmentally friendly than current climbing elements.

Reclaimed material from recycled products can be used during the manufacture of the climbing element according to the invention from thermoplastic material. Thus, the climbing element according to the invention can preferably be manufactured from acrylonitrile butadiene styrene (ABS) and/or polycarbonate (PC) from recycled material. When the climbing element according to the invention is disposed of, it can itself be easily recycled, which additionally improves the environmental performance of the climbing element according to the invention.

As a result, the invention represents a climbing element that is significantly more cost-effective, safer and at the same time more environmentally friendly than the prior art.

It also proves to be particularly advantageous if the counter-holding element has a frustoconical screw head socket. When using a wood screw with a countersunk head, the frustoconical screw head socket forms a precisely fitting screw head counterhold. When tightening a countersunk screw, the countersunk head lowers into the frustoconical screw head socket. This can prevent a sharp edge of the screw head protruding over the passage opening after tightening, on which a climber could injure himself. A rosette can preferably be used as a suitable counter-holding element with a frustoconical screw head socket.

In a particularly preferred embodiment of the invention, the counter-holding element is located in a depression. This ensures that the counter-holding element protrudes less on the visible side of the climbing element. On the one hand, this reduces snagging and thus the risk of injury for a climber, and on the other hand, visual perception is improved because the counter-holding element is less clearly perceptible.

In this context, it is particularly advantageous if the counter-holding element is fixed in the depression with adhesive. If the counter-holding element is fixed to the through-opening of the climbing element with a tubular rivet, the counter-holding element is reliably secured against falling off, but under certain circumstances it could still be twisted within the depression around the through-opening. Twisting in the depression can be prevented if the counter-holding element is additionally fixed in the depression with adhesive. Preferably, an impact-resistant adhesive is used that can withstand the jerky shearing that can result from using a cordless screwdriver.

In a particularly advantageous embodiment of the invention, the climbing element is deep-drawn. The advantage here lies in particularly economical manufacturing of the climbing element according to the invention by deep-drawing. The manufacture of large climbing elements, such as so-called "macros" or "volumes," benefits from this in particular, as this replaces the tedious, manual production of individual pieces. Deep-drawing allows several macros to be formed at once in one process. Deep-drawing is preferably carried out from thermoplastic sheets, such as ABS sheets with a thickness of between 3 and 10 mm. The fact that the climbing elements are always manufactured in the same way by deep-drawing also guarantees a consistently high product quality that is free of the individual fluctuations that are inherent in the manual production of individual pieces.

In a particularly preferred embodiment of the invention, the climbing element has a hollow hold body around which a flange is formed, through which the at least one through-opening passes. This embodiment can be manufactured particularly economically both by deep-drawing and injection molding. This embodiment of the invention provides a particularly light climbing element which can be manufactured using little material. Furthermore, the flange formed around the hollow hold body offers a planar and flat bearing surface for the climbing element on a climbing wall. A plurality of through-openings can easily be made through the flange, as a result of which the climbing element can be securely attached to a climbing wall.

It proves to be particularly advantageous if the counter-holding element is made of metal or ceramics. The climbing element according to the invention is thus equipped with a particularly hard-wearing reinforcing element. At the same time, suitable counter-holding elements made of metal or ceramics, such as solid metal rosettes or washers made of stainless steel or ceramics, are commercially available in a wide variety of designs. This allows the climbing element according to the invention to be manufactured inexpensively.

A particularly preferred embodiment of the invention provides that a coating of an epoxy resin primer layer and a quartz sand epoxy resin top layer is formed on the visible side of the climbing element. As a result, the climbing element according to the invention is given a non-slip surface. The epoxy resin primer layer serves as a primer, on which the actual top layer is applied. The top layer consists of a mixture of quartz sand and epoxy resin, which creates a rough surface texture. Since quartz sand is added to the top layer, it could easily flake off if applied directly to the plastic. However, this is reliably prevented by first applying an epoxy resin primer layer to the plastic, to which the quartz sand epoxy resin layer is then applied.

The object is also achieved by a climbing system with at least one embodiment of the climbing element according to the invention mounted on a climbing wall, the climbing element being attached to the climbing wall by a screw passing through the at least one through-opening.

Other features which are considered as characteristic for the invention are set forth in the appended claims.

Although the invention is illustrated and described herein as embodied in a climbing element and a climbing system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

The represented embodiments are not shown to scale in any of the figures, nor are the stipulations of technical drawing necessarily met. Rather, for the sake of clarity, certain features are shown particularly large in the schematic representations in comparison to other features of the invention.

Figure 1:
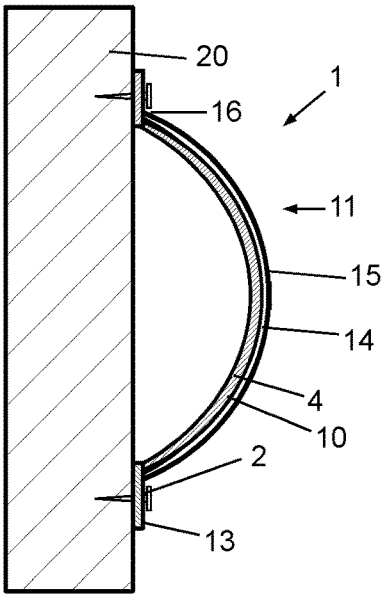
FIG. 1 is a diagrammatic, side view an embodiment of a climbing element attached to a climbing wall according to the invention.
Figure 2:
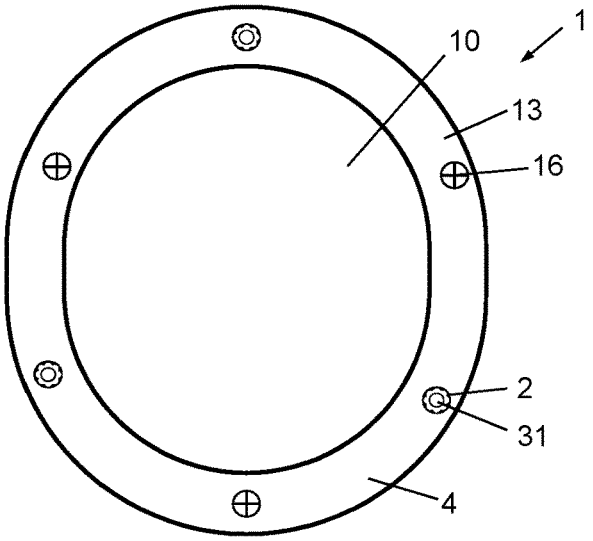
FIG. 2 is a to plan view of the climbing element from FIG. 1 of a visible side of the climbing element.

Referring now to the figures of the drawings in detail and first, particularly to FIGS. 1 and 2 thereof, there is shown schematically a possible embodiment of a climbing element 1 according to the invention in a side view (FIG. 1) and a plan view (FIG. 2). The climbing element 1 shown is a macro which was drawn from a 5 mm thick ABS plate by vacuum forming. The climbing element 1 has a hollow hold body 10 around which a flange 13 is formed. The hold body 10 bulges out from the flange 13. The flange 13 is flat.

Instead of an ABS plate, plates made of other thermoplastics can be used to manufacture the climbing element 1 by deep-drawing. The thickness of the plate used depends on the size of the climbing element 1 and also depends on how far the wall thickness of the resulting hold body 10 is reduced during deep-drawing compared to the original thickness of the plate.

Instead of deep-drawing, it is also particularly suitable to manufacture the climbing element 1 by injection molding.

In the embodiment shown in FIGS. 1 and 2, the flange 13 forms a wide, flat strip through which several through-openings 2 pass. In the embodiment shown, the flange 13 is 2 cm wide, but it can also have a different width, for example in a range from 1 cm to 5 cm. Furthermore, the width of the flange 13 can vary over its course. The dimensioning and exact shape of the flange 13 depends primarily on the size and shape of the hold body 10.

The flange 13 is provided with a plurality of through-openings 2 distributed around the hold body 10. The through-openings 2 serve as attachment points for the climbing element 1. The through-openings 2 can be arranged equidistantly around the hold body 10 and/or depending on the expected introduction of force, so that where there is higher stress, more attachment points are formed than in regions with lower stress, or where none or only low forces occur, no attachment points are formed.

The through-openings 2 can be drilled or punched into the flange 13 after deep-drawing. In the case of manufacture by injection molding, the through-openings 2 can be formed in the climbing element 1 during the injection molding process by a corresponding design of the mold.

Figure 3:
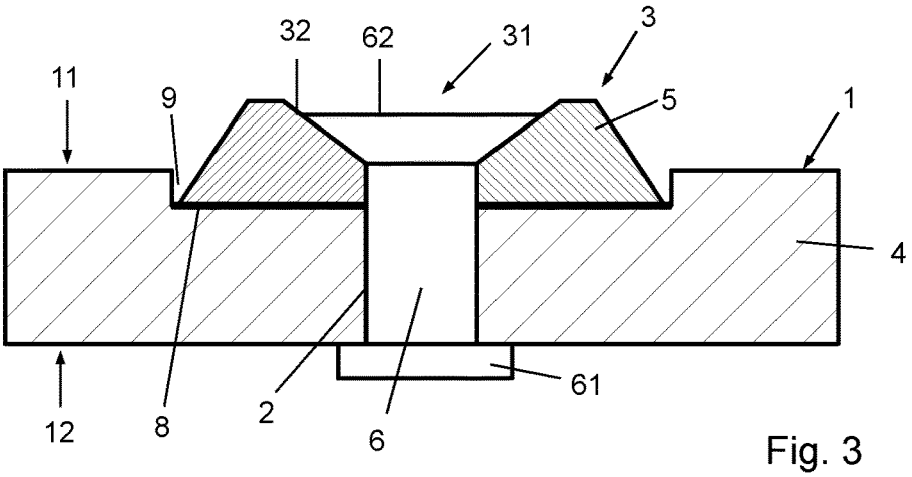
FIG. 3 is a sectional view of a region of a through-opening provided with a reinforcing element of one embodiment of the climbing element according to the invention.
Figure 4:
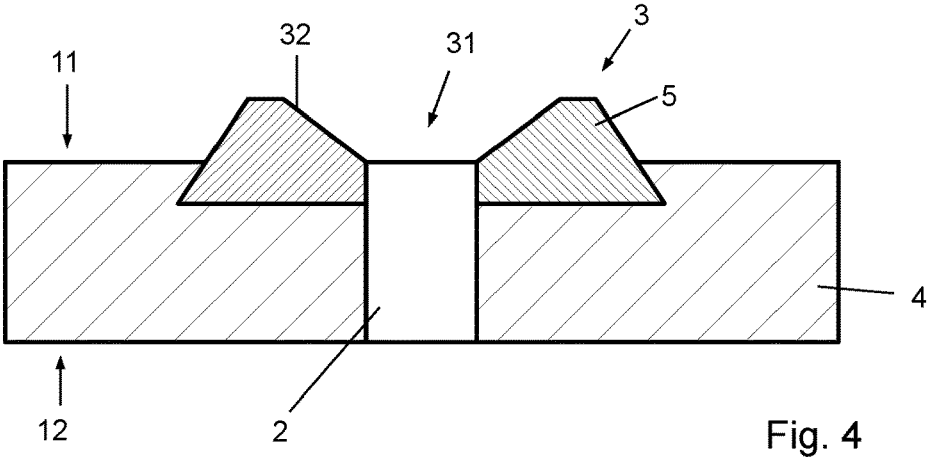
FIG. 4 is a sectional view showing a region of the through-opening provided with the reinforcing element of a further embodiment of the climbing element according to the invention.

Reinforcing elements 3 are located in the through-openings 2 and, for the sake of clarity, are illustrated separately with reference to FIGS. 3 and 4 and described in more detail.

A coating of an epoxy resin primer layer 14 and a quartz sand epoxy resin top layer 15 is formed on a visible side 11 of the climbing element 1. This gives the surface of the climbing element 1 a rough and non-slip surface texture, which offers a climber a non-slip stance on or a non-slip grip on the climbing element 1 according to the invention.

In the embodiment shown in FIG. 1, the climbing element 1 is screwed directly to the wood panels of a climbing wall 20 with screws 16. No nuts are therefore required on the climbing wall for attaching the climbing element 1 to the climbing wall 20 and the climbing element 1 can be positioned anywhere on the climbing wall 20.

In an embodiment that is not shown, the climbing element 1 is screwed to drive-in nuts with machine screws, which are driven in distributed over the climbing wall 20.

Attaching the climbing element 1 to the climbing wall 20 is in principle also possible with nails, but this type of attachment is difficult to remove.

FIG. 3 shows the region of a through-opening 2 of one embodiment of the climbing element 1 according to the invention.

The through-opening 2 is located in the flange 13 formed around the hollow hold body 10. The through-opening 2 runs from the visible side 11 of the climbing element to a rear side 12 of the climbing element through the thermoplastic material 4 of the climbing element 1.

A depression 9 is formed around the through-opening 2 on the visible side 11 of the climbing element 1. The depression 9 can either be milled into the flange 13 following the shaping of the climbing element or can be formed during shaping in the injection molding or deep-drawing process.

In the embodiment shown, a counter-holding element 5 is used as the reinforcing element 3 and is fixed to the through-opening 2 with a tubular rivet 6. The tubular rivet 6 is inserted into the through-opening 2 from the rear side 12 of the climbing element 1. A collar 61 of the tubular rivet 6 lies flat on the rear side 12 of the climbing element 1. A free end 62 of the tubular rivet 6 is passed through the counter-holding element 5 and then flanged. The counter-holding element 3 is held securely at the through-opening 2 by the tubular rivet 6. A reinforcing element 3 formed from the tubular rivet 6 and the counter-holding element 5 has a passage opening 31 for the passage of a screw 16.

In the shown embodiment of the climbing element 1 according to the invention, a solid metal rosette with a frustoconical screw head socket 7 serves as a counter-holding element 5, which provides a countersunk screw with a precisely fitting screw-head counterhold 32.

In an embodiment of the climbing element 1 according to the invention that is not shown, a flat washer serves as a counter-holding element 5. This forms a precisely fitting screw head counterhold 32 if, for example, a plate screw is used to attach the climbing element to a climbing wall. In addition to the use of washers or rosettes, a large number of alternative counter-holding elements 5, such as nuts, insertion sleeves or spring washers, can be used in the specific embodiment of the invention. In this way, precisely fitting counter-holding elements 5 can be selected for different fastening means.

The counter-holding elements 5 are preferably made of metal or ceramics, but other sufficiently hard and durable materials can also be used for their construction.

In the embodiment shown in FIG. 3, the all-metal rosette is additionally fixed in the depression 9 with adhesive 8. This can prevent the all-metal rosette, or any other counter-holding element 5, from twisting when attaching and detaching the climbing element 1 according to the invention to/from a climbing wall 20 in the depression 9. In order to withstand jerky shearing, for example when using a cordless screwdriver, an impact-resistant adhesive is particularly advantageous.

In FIG. 4, the region of the through-opening 2 provided with a reinforcing element 3 of a further embodiment of the climbing element 1 according to the invention is shown schematically.

In the embodiment shown, the counter-holding element 5 is attached without an additional tubular rivet 6. The reinforcing element 3 is identical to the counter-holding element 5 in this embodiment.

For attachment, the underside of the counter-holding element 5 is pressed into the thermoplastic material 4, which has been heated to deformability, until it overflows over the edge of the counter-holding element 5 as a result of displacement and runs on the upper side of the counter-holding element 5, so that the upper side of the counter-holding element 5 is at least partially covered by the thermoplastic material 4.

After cooling, the counter-holding element 5, which is partially sunk in the thermoplastic material 4, is firmly inserted in the thermoplastic material 4 and is reliably secured against falling off or slipping.

In this embodiment, it is not necessary for a depression 9 to be formed around the through-opening 2 since the counter-holding element 5 is necessarily sunk into the thermoplastic material 4 in this embodiment.

Likewise, in this embodiment, there is no need to additionally secure the counter-holding element 5 with adhesive 8.

After the counter-holding element 5 has been pressed into the thermoplastic material 4 and this has cooled down again, the through-opening 2 can be drilled or punched into the climbing element within the passage opening 31 of the reinforcing element 3.

The invention claimed is:

1. A climbing element, comprising:

a body including thermoplastic material and having at least one through-opening formed therein and running from a visible side to a rear side of the climbing element;

a reinforcing element disposed on or in said at least one through-opening, said reinforcing element having a passage opening formed therein and disposed concentrically with said at least one through-opening, said reinforcing element having an end forming a screw head counterhold; and said reinforcing element either being composed of a counter-holding element having said screw head counterhold and a tubular rivet protruding from said rear side into said at least one through-opening, wherein said tubular rivet having a collar lying on said rear side of the climbing element and a free end region of said tubular rivet opposite said collar of said tubular rivet passing through said counter-holding element and flanged, or said reinforcing element is a single element, an underside of said reinforcing element being partially pressed into said thermoplastic material of said body on the visible side of the climbing element, with an upper side of said reinforcing element being at least partially covered by said thermoplastic material with a portion of said upper side being free of said thermoplastic material.

2. The climbing element according to claim 1, wherein said counter-holding element has a frustoconical screw head socket.

3. The climbing element according to claim 1, wherein said body further having a depression formed around said at least one through-opening on the visible side of the climbing element, said counter-holding element is disposed in said depression.

4. The climbing element according to claim 3, further comprising an adhesive, said counter-holding element is fixed in said depression with said adhesive.

5. The climbing element according to claim 1, wherein the climbing element is deep-drawn.

6. The climbing element according to claim 1, further comprising:

a hollow hold body; and a flange formed around said hollow hold body and through said flange said at least one through-opening passes.

7. The climbing element according to claim 1, wherein said counter-holding element is made of metal or ceramics.

8. The climbing element according to claim 1, further comprising a coating of an epoxy resin primer layer and a quartz sand epoxy resin top layer being formed on the visible side.

9. A climbing system, comprising:

a climbing wall;

at least one screw; and at least one said climbing element according to claim 1, said at least one climbing element mounted on said climbing wall, said climbing element attached to said climbing wall by said at least one screw passing through said at least one through-opening.

* * * * *